US006439143B1

(12) United States Patent
Wade et al.

(10) Patent No.: US 6,439,143 B1
(45) Date of Patent: Aug. 27, 2002

(54) GARMENT PORTION PROCESSING ASSEMBLY

(75) Inventors: James Adam Wade, Alexander City, AL (US); William D. Crahen, Newport News, VA (US)

(73) Assignee: Russell Corporation, Inc., Atlanta, GA (US)

( * ) Notice: Subject to any disclaimer, the term of this patent is extended or adjusted under 35 U.S.C. 154(b) by 0 days.

(21) Appl. No.: 09/620,052

(22) Filed: Jul. 20, 2000

(51) Int. Cl.[7] ..... D05B 37/08
(52) U.S. Cl. ..... 112/470.05; 112/122.3
(58) Field of Search ..... 112/470.05, 475.09, 112/304, 470.36, 122, 122.3, 147, 153, 152, 475.06; 83/331, 901, 936, 938

(56) References Cited

U.S. PATENT DOCUMENTS 3,970,021 A * 7/1976 Meadows et al.
4,112,860 A * 9/1978 Ellington et al.
4,324,004 A * 4/1982 Smith et al. ..... 112/475.092
5,596,939 A * 1/1997 Lavelle et al. ..... 112/470.362

* cited by examiner

*Primary Examiner*—Ismael Izaguirre
(74) *Attorney, Agent, or Firm*—Christopher A. Holland; Robert J. Veal; Burr & Forman LLP

(57) ABSTRACT

A garment portion processing assembly receives uncut material to process the material into a desired shape, such as the shape of a shirt collar, and then organize the formed material into separate stacks. The garment portion processing assembly includes a stack queuing assembly, a garment portion cutting apparatus, and a garment receiving assembly. In operation, the stack queuing assembly prepares the stacks of garment portions to be collected by the garment portion cutting apparatus to be processed. The garment portion cutting apparatus then collects the garment portions and processes the garment portions as desired by the user. The garment portion cutting apparatus includes a folding assembly for precisely folding the garment portion in an even manner, a shaping knife assembly treat is used to trim the garment portion according to the desired pattern, and a width knife assembly that makes sure the garment portion has the proper width. Lastly, after the garment portion is trimmed by the garment portion cutting apparatus, it is delivered to the collar receiving assembly to be stacked with the other processed garment portions for collection by the user.

33 Claims, 13 Drawing Sheets

FIG. 4
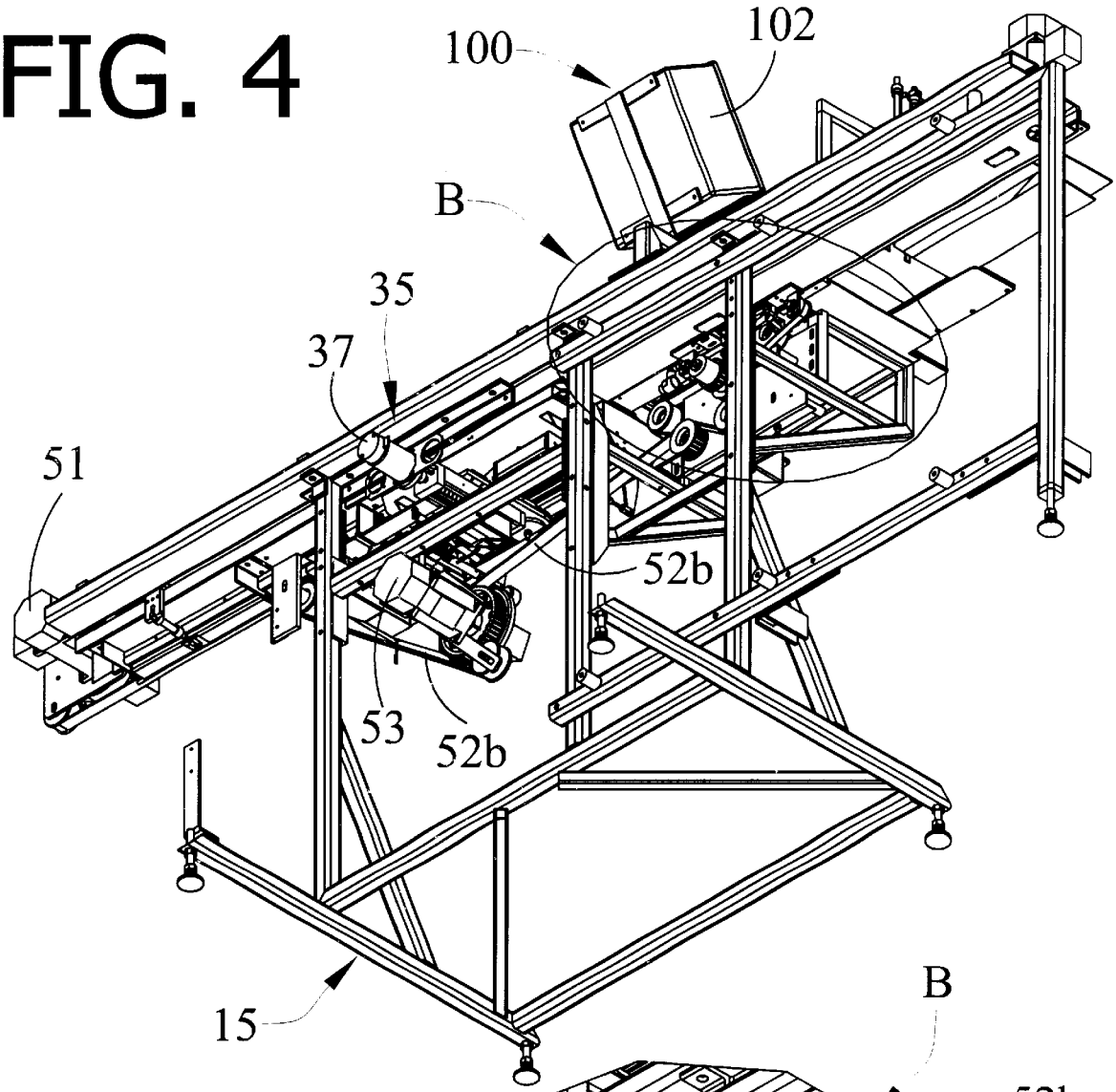
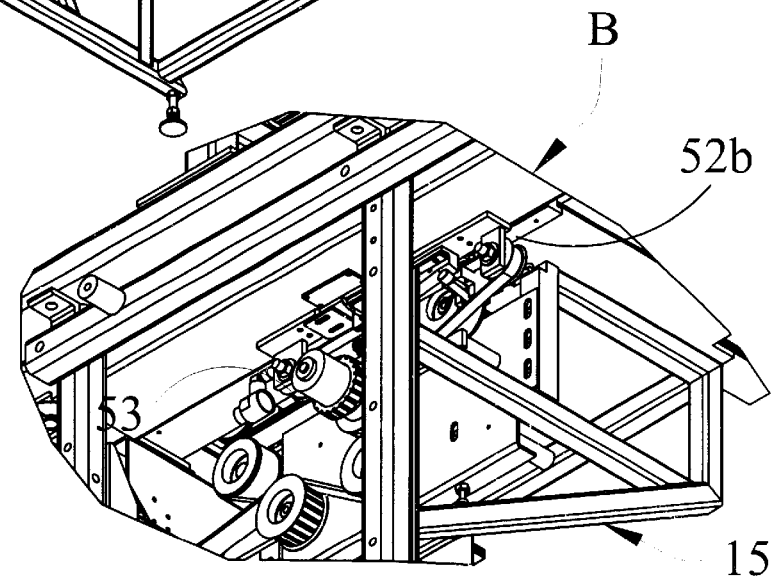
FIG. 5

GARMENT PORTION PROCESSING ASSEMBLY

FIELD OF THE INVENTION

The present invention relates to the field of textiles and more particularly to the field of manufacturing of garments from textiles. More specifically, the present invention relates to a garment portion processing assembly used to cut and notch a garment portion, such as a shirt collar, with respect to a predetermined standard pattern in order to facilitate the sewing of the garment portion to a garment.

BACKGROUND OF THE INVENTION

In the garment producing industry efforts have been made to reduce the amount of time consumed in producing garments and the amount of labor required to produce each individual garment. To this end automated sewing devices have been produced which enable the production line to stitch hems and seams of garments in an assembly line like fashion. However, these sewing devices do not provide for the efficient processing of independent garment portions, such as shirt collars, so that the garment portions may be attached to the remaining garment. Such sewing functions are conventionally performed by the personal operator rather than by an automated process, which reduces the efficiency of the production and assembly of the garments.

Accordingly, what is needed is a garment portion processing assembly that will prepare a garment portion, preferably a shirt collar, that is available to readily be sewed onto the garment.

SUMMARY OF THE INVENTION

It is an object of the present invention to provide an automated system to cut and notch garment portions such as shirt collars on a production line without requiring an operator to cut and notch the garment portion.

It is a further object of the present invention to provide an automated system that will collect individual garment portions from a stack of garment portions for the individual garment portion to be trimmed and notched.

It is a further object of the present invention to provide an automated system that will collect an individual garment portion and fold that garment portion such that the ends of the garment portion are positioned adjacent each other.

It is a further object of the present invention to provide an automated system that will trim and shape an individual garment portion according to a design desired by the user with minimal help from that user.

It is a further object of the present invention to provide an automated system that will trim the width of an individual garment portion according to desired dimensions set by the user.

It is a further object of the present invention to provide an automated system that will provide a notch in a garment portion to assist individuals in attaching the garment portion to the garment.

It is yet a further object of the present invention to provide an automated system that will stack the garment portions that have been cut and notched for users to collect to distribute to additional individuals for attachment to garments.

These and other objects and advantages of the invention will become apparent from the following detailed description of the preferred embodiment of the invention. The present invention is a garment portion processing assembly that operates to receive uncut material and process the material into a desired shape, such as the shape of a shirt collar. The garment portion processing assembly includes three main components: a stack queuing assembly, a garment portion cutting apparatus, and a garment receiving assembly. In operation, the stack queuing assembly prepares the stacks of garment portions to be collected by the garment portion cutting apparatus to be processed. The garment portion cutting apparatus then collects the garment portions and processes the garment portions as desired by the user. The garment portion cutting apparatus includes a folding assembly for precisely folding the garment portion in an even manner, a shaping knife assembly that is used to trim the garment portion according to the desired pattern, and a width knife assembly that makes sure the garment portion has the proper width. Finally, after the garment portion is trimmed by the garment portion cutting apparatus, it is delivered to the garment receiving assembly to be stacked with the other processed garment portions for collection by the user.

BRIEF DESCRIPTION OF THE DRAWINGS

A garment portion processing assembly embodying features of the invention is described in the accompanying drawings which form a portion of this disclosure and wherein:

FIG. 4 is a bottom perspective view of the garment portion cutting apparatus as illustrated in FIG. 2;

FIG. 5 is an enlarged view of a section of the garment portion cutting apparatus used in the garment portion as illustrated in FIG. 4, the present view taken within the line B;

DETAILED DESCRIPTION OF THE PREFERRED EMBODIMENT

Figure 1:
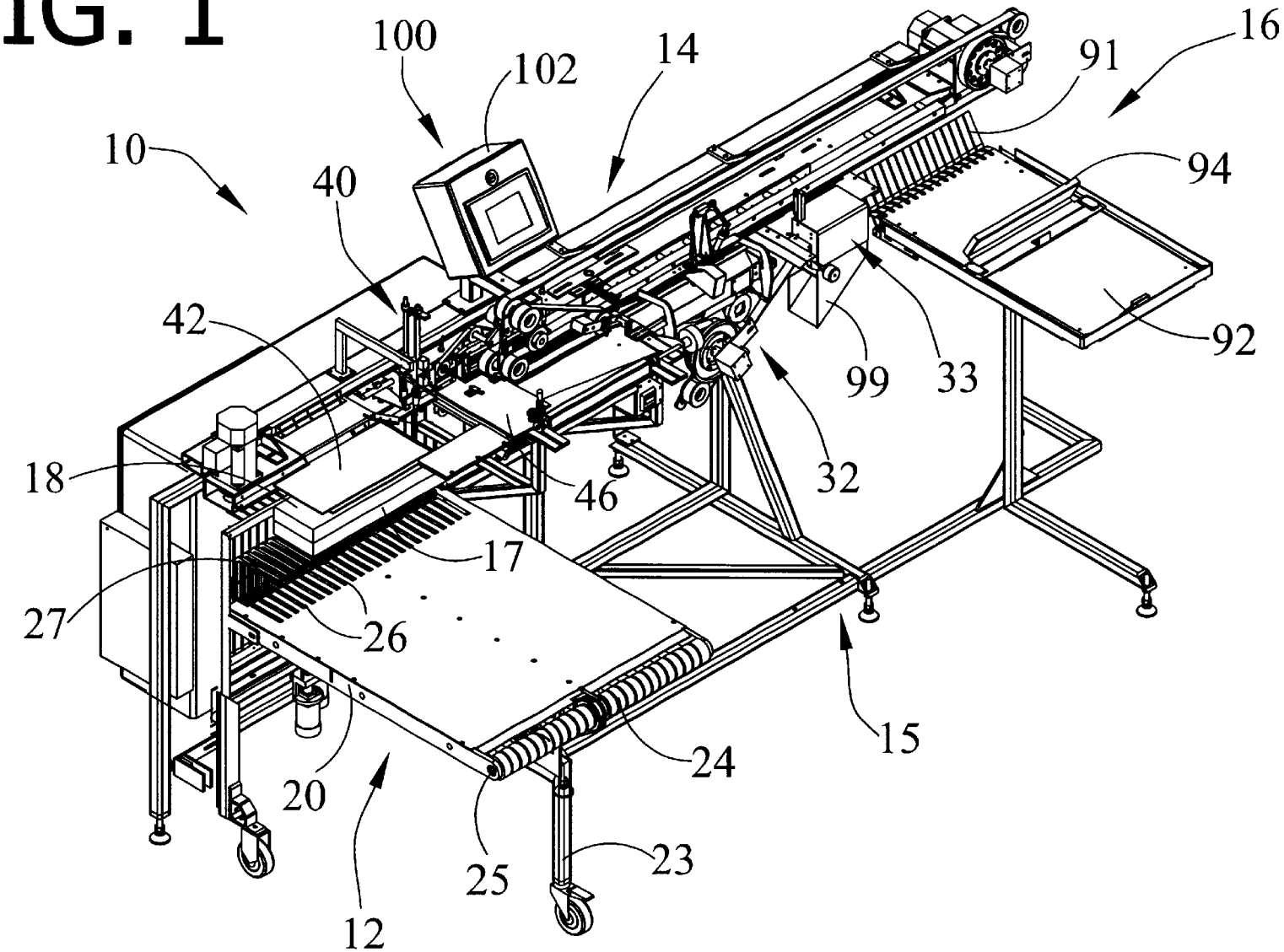
FIG. 1 is a front perspective view of the present invention of a garment portion processing assembly.

The present garment portion processing assembly 10 is illustrated in FIGS. 1–5. The garment portion processing assembly 10 includes a stack queuing assembly 12, a garment portion cutting apparatus 14, and a garment receiving assembly 16. The stack queuing assembly 12 is designed to initially hold at least one stack 17 of garment portions 18 (preferably shirt collars) that are to be cut and notched, and the stack queuing assembly 12 is connected to the garment portion cutting apparatus 14 such that the garment portion cutting apparatus 14 may take individual garment portions 18 from the stack 17 for processing. Once processed by the garment portion cutting apparatus 14, the individual garment portion 18 is then dispensed to the garment receiving assembly 16 so that the trimmed garment portions 18 can be collected by the user.

Continuing to view FIG. 1, each stack 17 of garment portions 18 is initially positioned on the stack queuing assembly 12 by the user. The stack queuing assembly 12 includes a base plate 20 that is supported by a transportable scaffold 23. The base plate 20 is surrounded by a series of so garment belts (not illustrated,) that engage a series of rollers 24 rotatably mounted to a driving shaft 25. The stacks 17 of garment portions 18 are placed on the garment belts and the base plate 20. The garment belts, as driven by the driving shaft 25, rotate around the base plate 20 causing the stacks 17 of garment portions 18 to move toward the garment portion cutting apparatus 14. Moreover, a series of finger slots 26 traverse one end of the base plate 20, with the finger slots 26 being designed to allow a row of finger members 27 to be raised therethrough to engage the stacks 17 of garment portions 18.

In operation, the stacks 17 are placed on the base plate 20, slid via the garment belts to a position above the finger slots 26, and then engaged by the finger members 27 to be elevated for collection by the garment portion cutting apparatus 14. The garment portion cutting apparatus 14 then lifts one end of a garment portion 18 from the stack 17 located on the automatic stack queuing device 12. Once the individual garment portion 18 is removed, the stack queuing device 12 raises the stack 17 of garment portions 18 so that as the garment portions 18 are removed, the uppermost garment portion 18 of the stack 17 is maintained at a somewhat constant height for loading.

In order to maintain the stack 17 of garment portions 18 at a constant height for engagement by the garment portion cutting apparatus 14, a light sensor (not illustrated) may be included to monitor the top of the stack 17 of garment portions 18. The light sensor is able to monitor various colors of garment portions 18 and detect when the height of the stack 17 of garment portions 18 changes, regardless of the color of the material. To facilitate the removal of the garment portions 18 from the stack 17, a gripper member 38 is set to grip the garment portion 18 at a predetermined height. As a result, the subjacent stack 17 must be incrementally raised on the finger members 27 each time a garment portion 18 is removed from the stack 17. To accomplish this, the sensor is mounted at a desired height in conjunction with a flexible metallic finger (not illustrated) which carries thereon an upturned vane (not illustrated) and which is moved upwardly by the press of garment portions 18 therebeneath such that the vane blocks an infrared beam directed to a panel (not illustrated) from a light source (not illustrated). When the vane interrupts the infrared light being directed at the stack 17, a vertical actuator (not illustrated) that lifts the finger members 27 will cease operation and the uppermost garment portion 18 will be at the proper height for removal by the garment portion cutting apparatus 14.

Once the stack 17 of garment portions 18 is substantially depleted, a second stack 17 of garment portions 18 is slidably moved, via the garment belts, into a position above the finger slots 26 and below the first stack 17 of garment portions 18. A second row of finger members 27 are elevated through the finger slots 26 to engage and lift the second stack 17 of garment portions 18. The second row of finger members 27 raises the second stack 17 of garment portions 18 to engage the first stack 17 of garment portions 18, wherein the second stack 17 of garment portions 18 joins the bottom of the first stack 17 of garment portions 18 in such a fashion as to cause no interruption in the functioning of the stack queuing device 12. The first row of finger members 27 is retracted away from the base plate 20, with the new combined stack 17 of garment portions 18 resting upon the second row of finger members 27.

Figure 2:
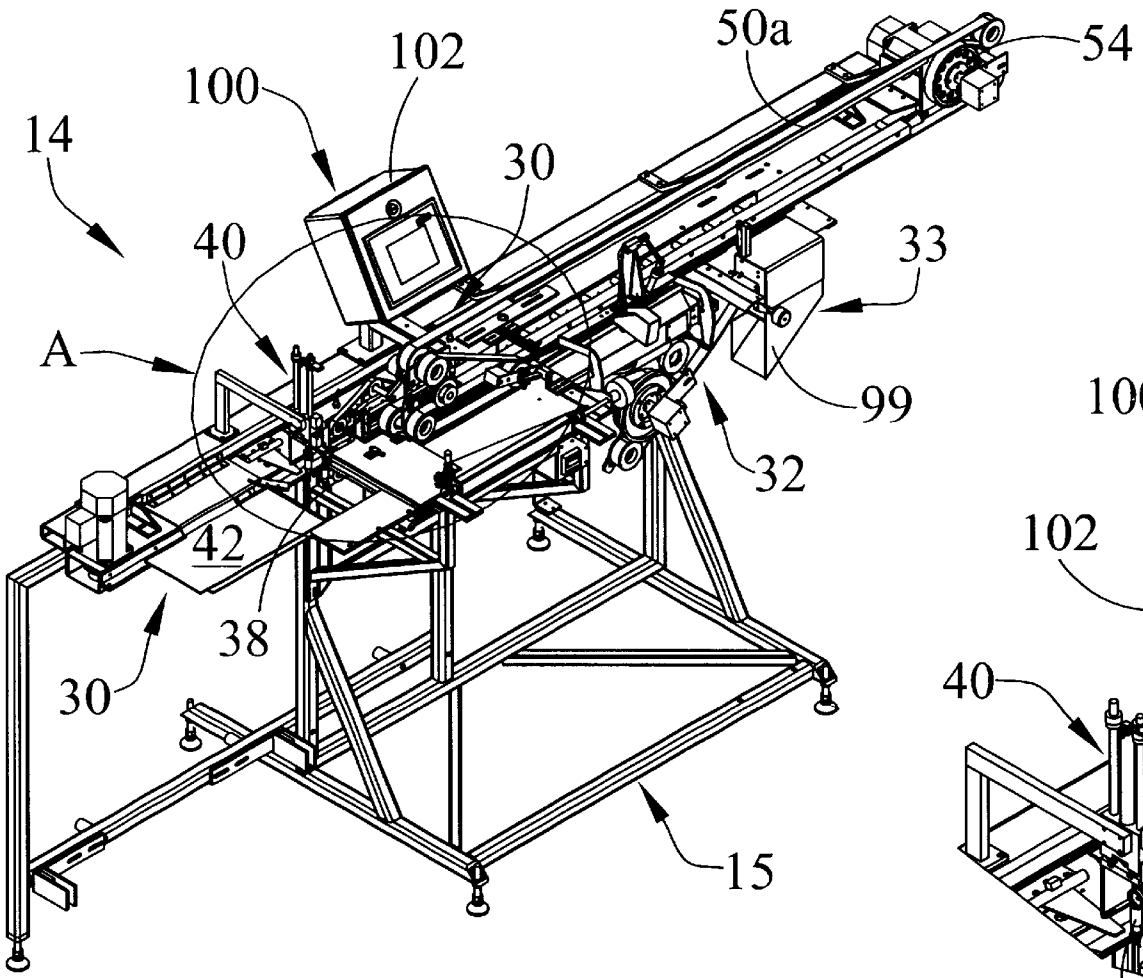
FIG. 2 is a top perspective view of the garment portion cutting apparatus used in the garment portion processing assembly of the present invention.

The garment portion cutting apparatus 14 is illustrated in FIG. 2, with the stack queuing device 12 and garment receiving assembly 16 detached. The garment portion cutting apparatus 14 includes a frame 15 supporting three general components: a folding assembly 30, a shaping knife assembly 32, and a width knife assembly 33. The folding assembly 30 is used to obtain one garment portion 18 from the stack queuing device 12 and evenly position the garment portion 18 on a garment plate 42 for trimming. The shaping knife assembly 32 receives the garment portion 18 from the folding assembly 30 and trims the garment portion 18 to have the proper aesthetic shape as desired by the user. The shaping knife assembly 32 is further connected to the width knife assembly 33 wherein the width of the garment portion 18 is trimmed according to the desired size. Finally, the width knife assembly 33 dispenses the garment portion 18 to the garment receiving assembly 16 so that the trimmed garment portions 18 may be grouped together.

Figure 3:
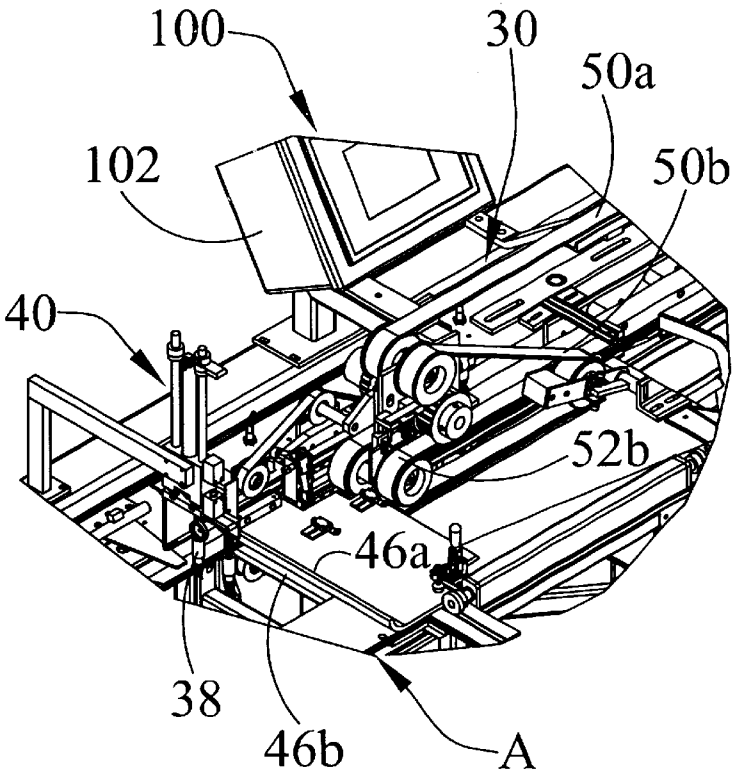
FIG. 3 is an enlarged view of a section of the garment portion cutting apparatus used in the garment portion as illustrated in FIG. 2, the present view taken within the line A.

Looking at the enlarged view in FIG. 3, the folding assembly 30 includes the gripper member 38 that is used to engage the uppermost garment portion 18 from the stack 17. The gripper member 38 is attached to elevating means 40 for vertically raising and lowering the gripper member 38 as desired by the user, with the elevating means 40 preferably being a pneumatic or hydraulic cylinder. The folding assembly 30 additionally includes the garment plate 42 that is slidably mounted to the frame 15, the garment plate 42 being laterally moved to engage the garment portion 18 after the garment portion 18 has been raised by the gripper member 38. In operation, the gripper member 38 is lowered to engage and lift the uppermost garment portion 18 to a position above the garment plate 42. The garment plate 42 is then slid between the raised gripper member 38 and the remaining stack 17 so that the free section of the garment portion 18 is peeled off the stack 17. This results in a portion of the garment portion 18 lying on top of the garment plate 42. The gripper member 38 then releases the garment portion 18 such that the remaining garment portion 18 will fall on to the garment plate 42. Generally, the garment portion 18 will fall on the garment plate 42 such that approximately three inches of the garment portion 18 will hang over the edge of the garment plate 42.

Once the garment portion 18 is placed on the garment plate 42, the sides of the garment portion 18 are aligned by sliding the garment plate 42 carrying the garment portion 18 through a chute comprised of a pair of fixed plates 46 and tapered side guides (not illustrated). The side guides are positioned so that the exit width between the side guides is equal to the width of the garment portion 18, forcing the top and the bottom of the garment portion 18 into alignment with respect to each other.

After alignment on the garment plate 42, the garment portion 18 is then folded around the edge of the garment plate 42 such that exactly half of the garment portion 18 is on the upper surface of the garment plate 42 and the other half of the garment portion 18 engages the underside surface of the garment plate 42. This positioning of the garment portion 18 is achieved through the introduction of the garment portion 18 via the garment plate 42 between first and second upper folding belts 50*a*, 50*b* and first and second lower folding belts 52*a*, 52*b* (see FIG. 6). The upper folding belts 50*a*, 50*b* and lower folding belts 52*a*, 52*b* operate to guide the end of the garment portion 18 past a sensor means (not illustrated) to properly fold the garment portion 18. The sensor means preferably includes a first photoelectric sensor above the garment plate 42 and a second photoelectric sensor positioned below the garment plate 42. The first sensor is located directly above the lower sensor such that both sensors are in line to monitor the same location on the garment plate 42. When the lower end of the garment portion 18 reaches the second sensor, the lower folding belts 52*a*, 52*b* stop and hold the garment portion 18 in place on the garment plate 48. The belt speeds of the upper and lower folding belts 50*a*, 50*b*, 52*a*, and 52*b* are varied as necessary to move the garment portion 18 around the edge of the garment plate 42 without introducing either excessive tension or allowing excessive slack in the garment portion 18. When the top end of the garment portion 18 reaches the first sensor, the precise alignment of the garment portion 18 on the garment plate 42 is complete.

Additionally, when the lower end of the garment portion 18 passes the first sensor, a small edge guide shoe (not illustrated) is lowered onto the end board corner of the garment portion 18, and a clutch (not illustrated) is engaged allowing the guide shoe to travel along beside the end of the garment portion 18. As the garment portion 18 advances, a cam (not illustrated) causes the guide shoe to pull the corner of the garment portion 18 perpendicular to the direction of travel of the garment portion 18 until the garment portion 18 engages a stationary edge stop (not illustrated). Additional guide motions simply result in the guide shoe slipping on the surface of the garment portion 18. A similar mechanism engages the top end of the garment portion 18, with the result being precise width alignment of the ends of the garment portion 18.

Once the garment portion 18 is folded, the upper folding belts 50*a*, 50*b* and the lower folding belts 52*a*, 52*b* are then run at the same speed in order to transport the garment portion 18 to the first of two cutting operations. Due to the inherent curvature and stiffness of the garment portion 18, there is a tendency for it to spring back to its original shape during transportation. Tight clamping by the upper and lower folding belts 50*a*, 50*b*, 52*a* and 52*b* is required to prevent this spring back action of the garment portion 18. A pneumatic loading mechanism (not illustrated) allows a high clamp force to be applied to one section of the folding belts 50*a*, 50*b*, 52*a* and 52*b* holding the garment portion 18, while applying no belt contact force to other sections of the folding belts 50*a*, 50*b*, 52*a* and 52*b*. Such an arrangement is allowed in the actual upper and lower folding belts 50*a*, 50*b*, 52*a*, and 52*b* that are used with the present invention.

Figure 6:
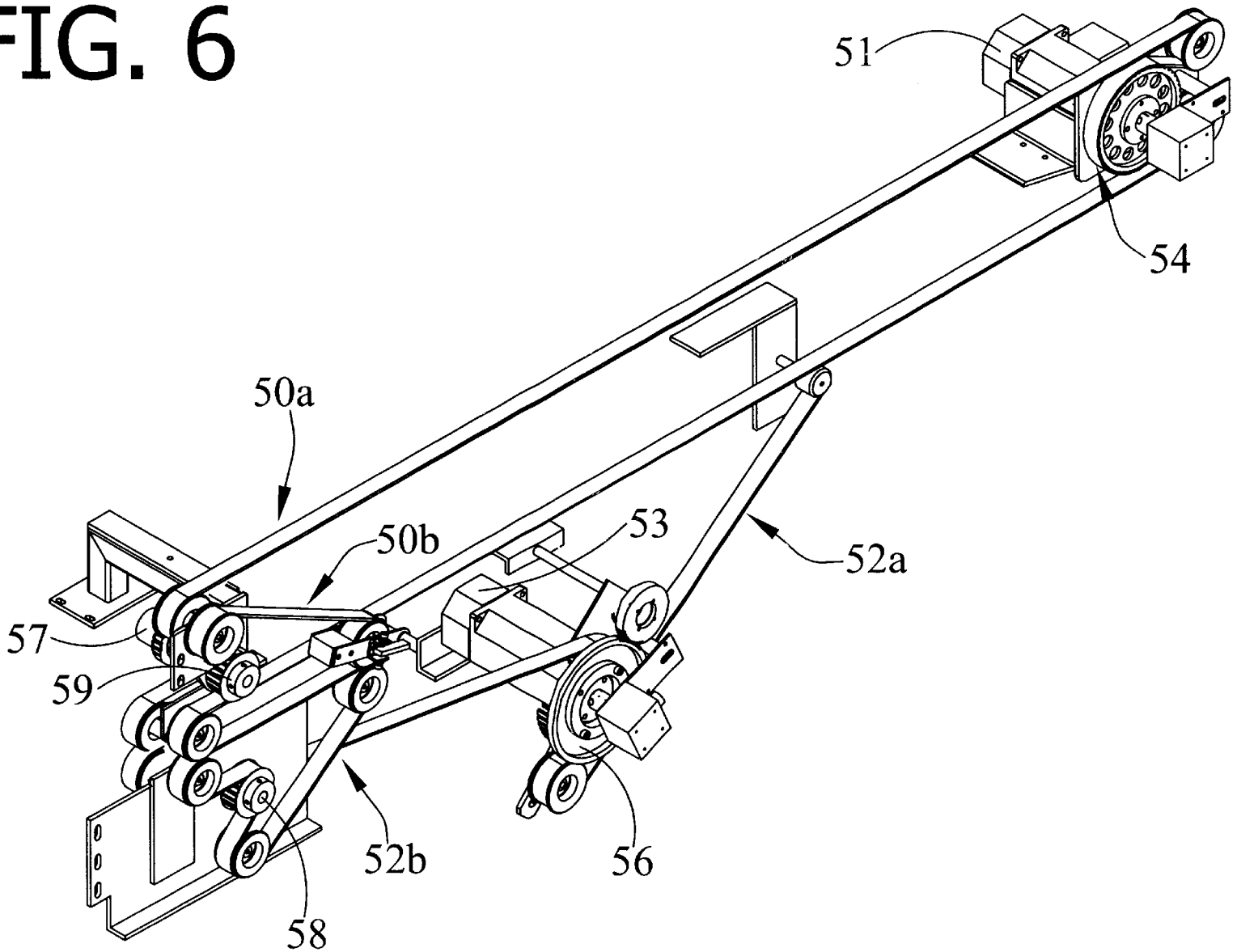
FIG. 6 is a perspective view of the folding belt assembly used in the garment portion cutting apparatus of the present invention.
Figure 7A:
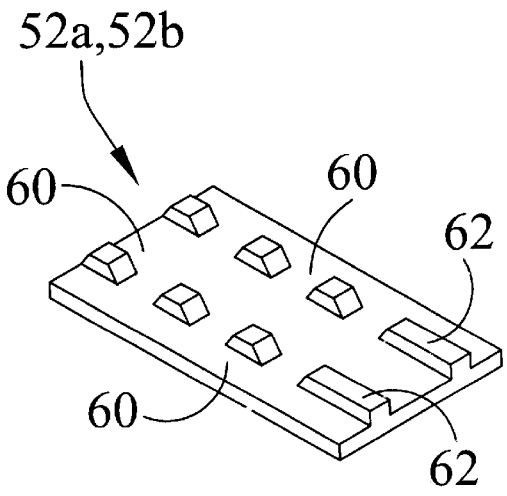
FIG. 7A is a top perspective view of the upper folding belt used in the present invention.
Figure 7B:
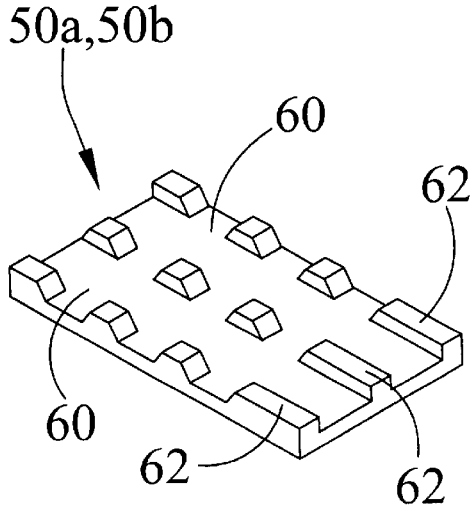
FIG. 7B is a top perspective view of the lower folding belt used in the present invention.
Figure 8A:
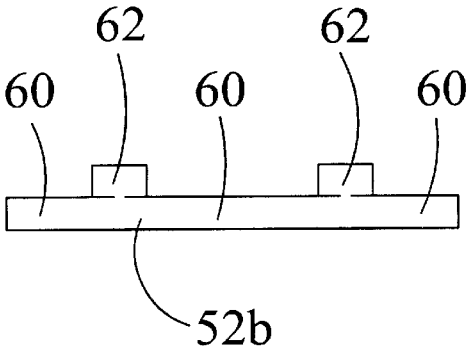
FIG. 8A is a sectional view of the upper folding belt used in the present invention.
Figure 8B:
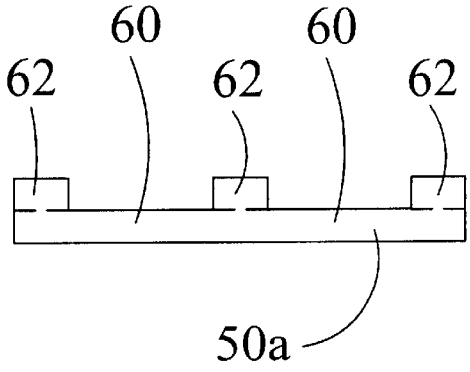
FIG. 8B is a sectional view of the lower folding belt used in the present invention.

Continuing to view FIG. 6, each folding belt 50*a*, 50*b*, 52*a*, and 52*b* is driven by a motor and a set of pulleys. The first upper folding belt 50*a* is driven by first upper pulley 54 that is connected to a first upper motor 51. The first lower folding belt 52*a* is driven by a first lower pulley 56 that is connected to a first lower motor 53. The second upper folding belt 50*b* is driven by second upper pulley 59. Similarly, the second lower folding belt 52*b* is driven by a second lower pulley 58.

Looking at FIGS. 7A, 7B, 8A, and 8B, all of the folding belts 50*a*, 50*b*, 52*a*, and 52*b* are designed with longitudinal grooves 60 that are machined between a series of ridges 62. The upper folding belts 50*a*, 50*b* have two machine longitudinal grooves 60 resulting in three small ridges 62 (see FIGS. 7B and 8B). The lower folding belts 52*a*, 52*b* have three grooves 60, resulting in two ridges 62 (see FIGS. 7A and 8A). The lower ridges 62 are located so as to fit between the upper ridges 62, allowing the belts 50*a*, 50*b*, 52*a* and 52*b* to move relative to each other while tightly engaging the garment portion 18 (the belts of the prior art machines frequently lock during operation). The lower folding belts 52*a*, 52*b* are supported on a rigid belt guide (not illustrated) with shallow side walls. The upper folding belts 50*a*, 50*b* are supported by a flexible plastic guide (not illustrated), which is forced downward by the pneumatic bladder (not illustrated). Guide ridges (not illustrated), which run down both sides of the flexible plastic guide (not illustrated), limit the downward motion of any section of the plastic guide (due to the bladder). When one guide ridge encounters its lower stop ledge, the stop resists the bladder's downward force, and no further motion is possible. This travel limit is set so that the belt ridges 62 do not come into contact with each other such that the upper folding belts 50*a*, 50*b* experience no contact force with the lower folding belts 52*a*, 52*b* unless a garment portion 18 is positioned between the upper folding belts 50*a*, 50*b* and the lower folding belts 52*a*, 52*b*. Introduction of a garment portion 18 between the folding belts 50*a*, 50*b*, 52*a*, and 52*b* requires that the ridges move apart, forcing the plastic guide off the stop and transferring the force of the bladder back to that section of the belt 50*a*, 50*b*, 52*a*, and 52*b*.

Referring back to FIG. 6, the preferred embodiment of the present invention comprises split top and bottom folding belts 50*a*, 50*b*, 52*a*, and 52*b* so that the production speed may be increased as well. These split folding belts 50*a*, 50*b*, 52*a*, and 52*b* allow the previously described functions to operate independently in a pipeline arrangement. However, a single top folding belt 50*a* and a single bottom folding belt 52*a* may be implemented as desired by the user.

Once the garment portion 18 has been precisely aligned by the folding assembly 30, the first upper and lower folding belts 50*a* and 52*a* transport the garment portion 18 to the shaping knife assembly 32 to be trimmed according the style desired by the user. Looking at FIGS. 9A–12, the shaping knife assembly 32 includes a clamping means 64 having a pair of arms 68 attached to the ends of a clamping member 66. The clamping means 64 is pivotally attached between two end plates 65, with a cover plate 65*a* additionally connected between the end plates 65 for protection of the motors and a first cutting member 76 used in the shaping knife assembly 32. Moreover, a clamping plate 67 is connected to the uppermost surfaces of both end plates 65. The clamping means 64 is pivotable to secure the garment portion 18 to the clamping plate 67 to prevent the garment portion 18 from curling while being trimmed.

Figure 9A:
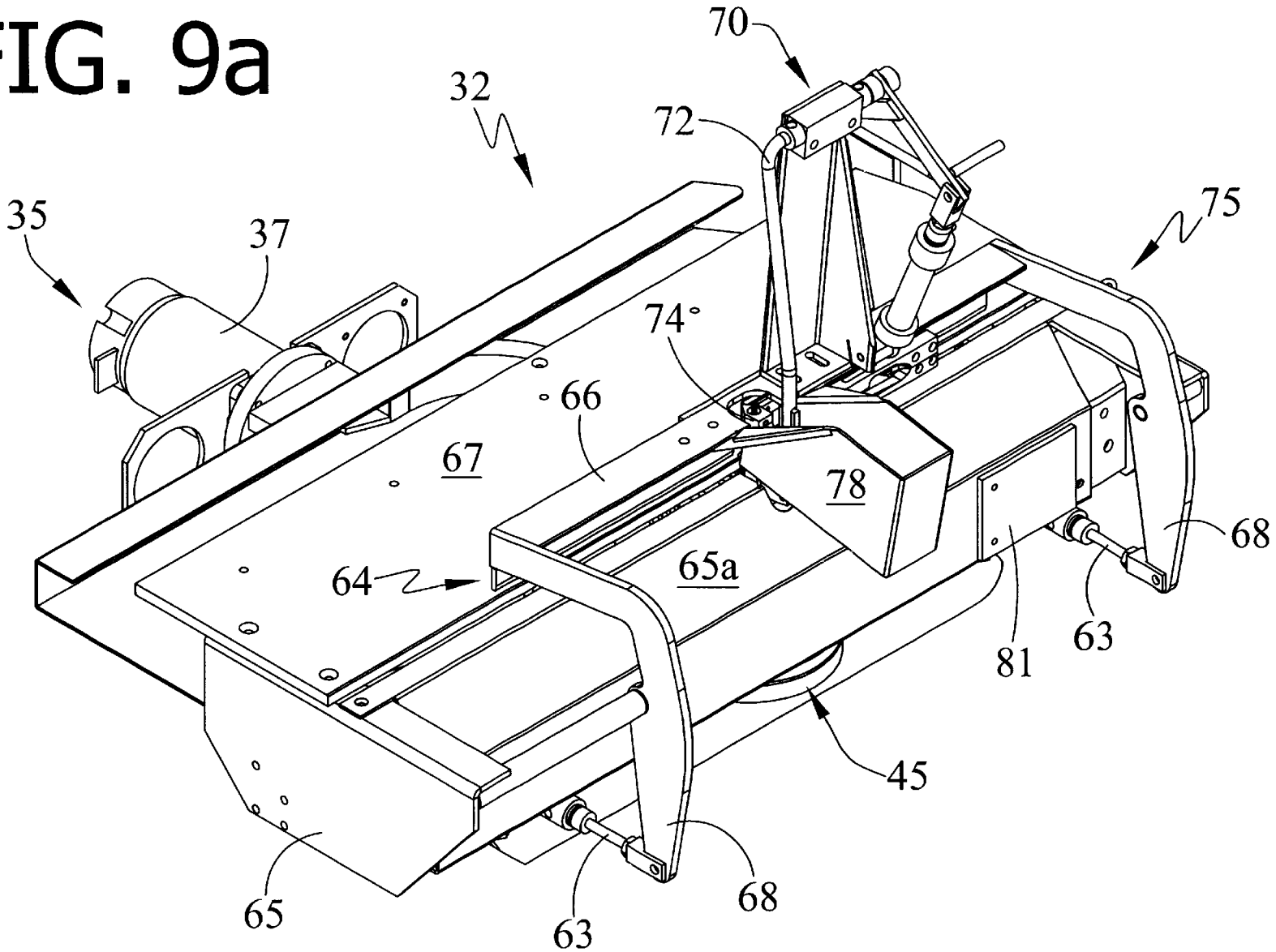
FIG. 9A is a first top perspective view of the shaping knife assembly of the present invention.
Figure 9B:
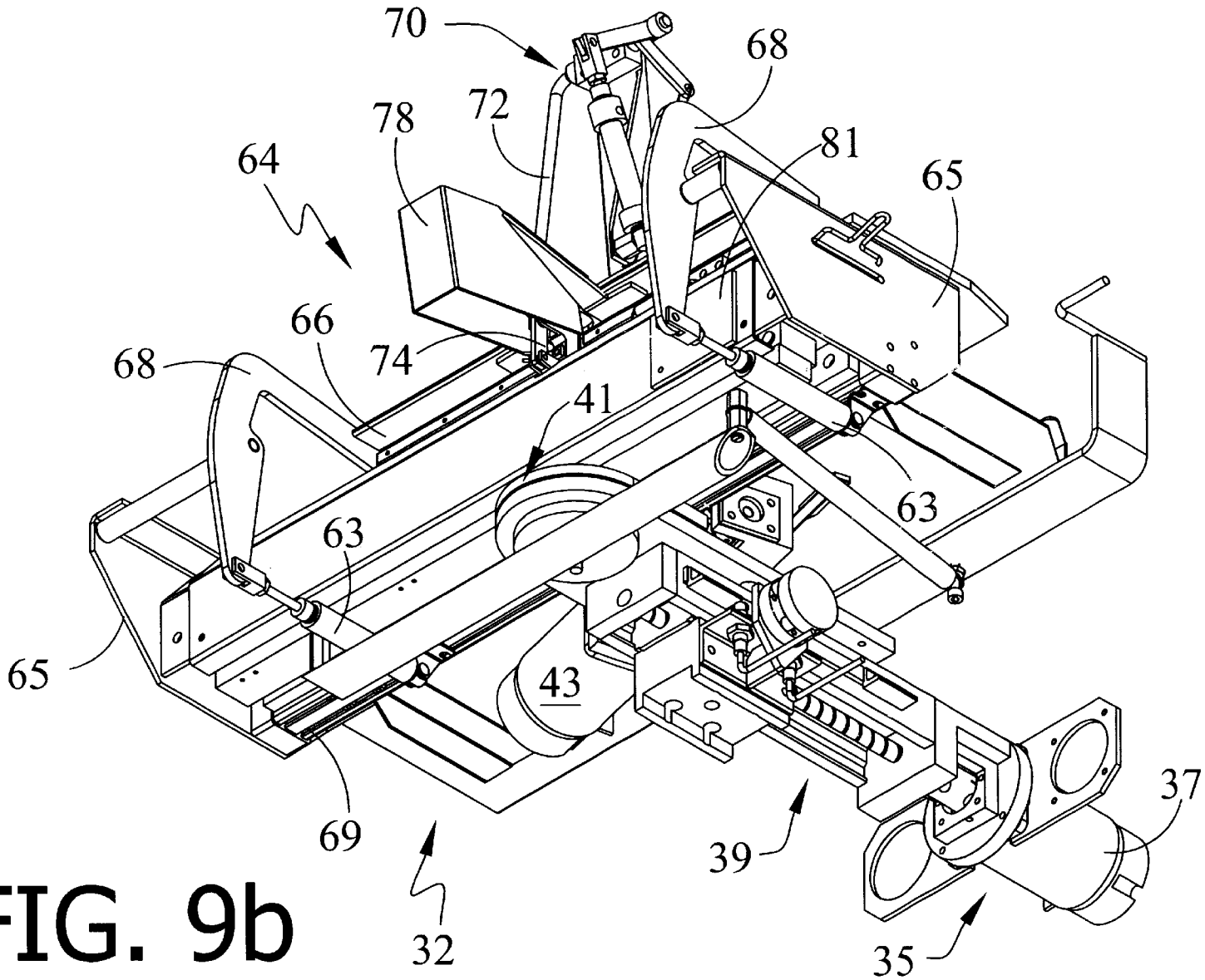
FIG. 9B is a bottom perspective view of the shaping knife assembly of the present invention.
Figure 9C:
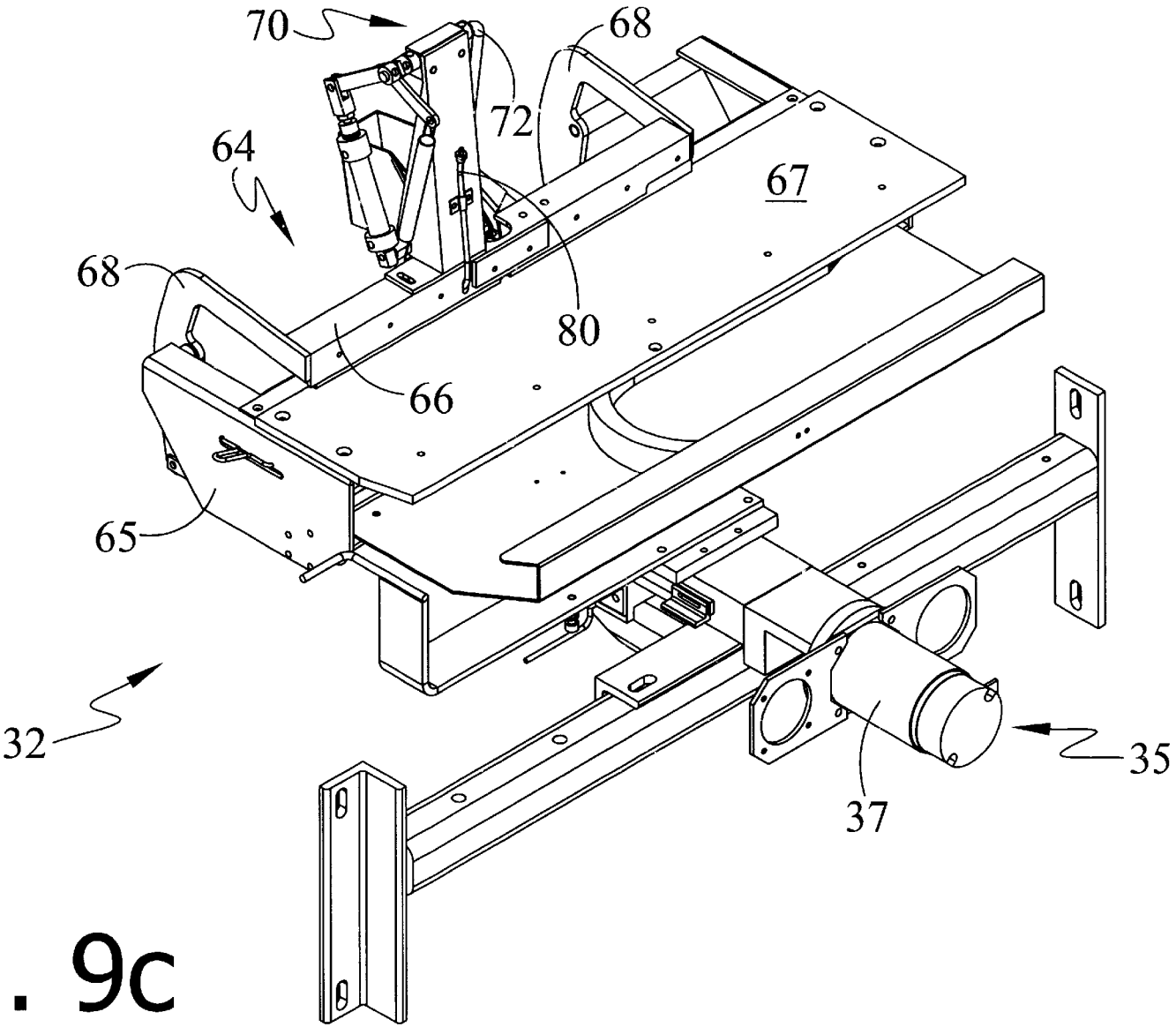
FIG. 9C is a second top perspective view of the shaping knife assembly of the present invention.

The shaping knife assembly 32 further includes a lateral placing means 35, which typically includes a primary motor 37 and a worm screw assembly 39 (see FIG. 9B). A swivel member 41 is attached to the end of the lateral placing means 35, with the first cutting member 76 being attached to the swivel member 41. The lateral placing means 35 will extend and retract the swivel member 41 to vary the degree that the first cutting member 76 engages the garment portion 18. Moreover, the shaping knife assembly 32 further includes a secondary motor 43 to which the first cutting member 76 is also attached. The secondary motor 43 is attached to a swivel member 41 to angularly move the first cutting member 76 to cut the desired pattern in the garment portion 18. Additionally, an access door 81 is attached to the cover plate 65*a* to provide access to the first cutting member 76 by the user if required.

Figure 10:
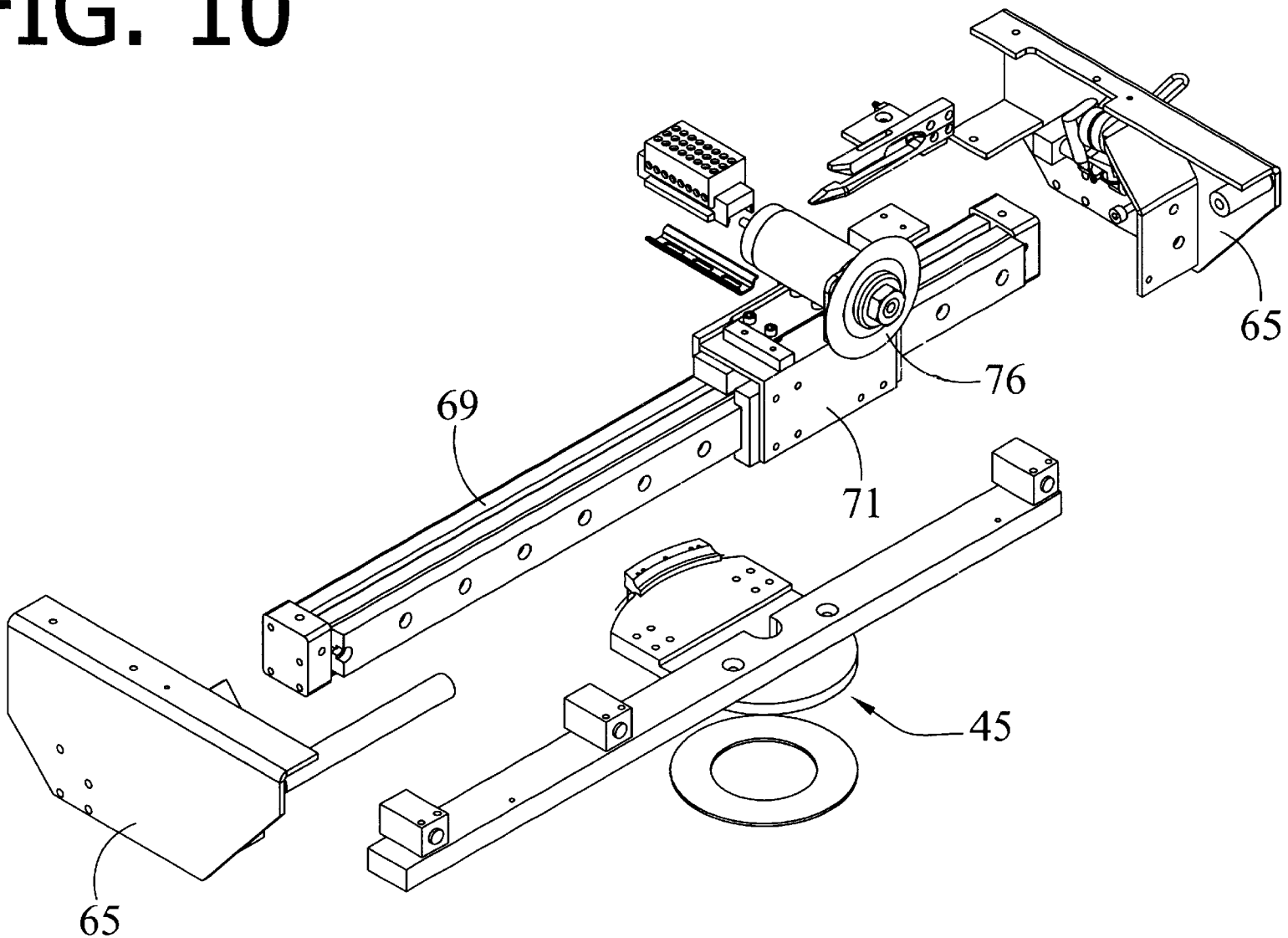
FIG. 10 is an exploded view of the shaping knife assembly of the present invention.
Figure 11:
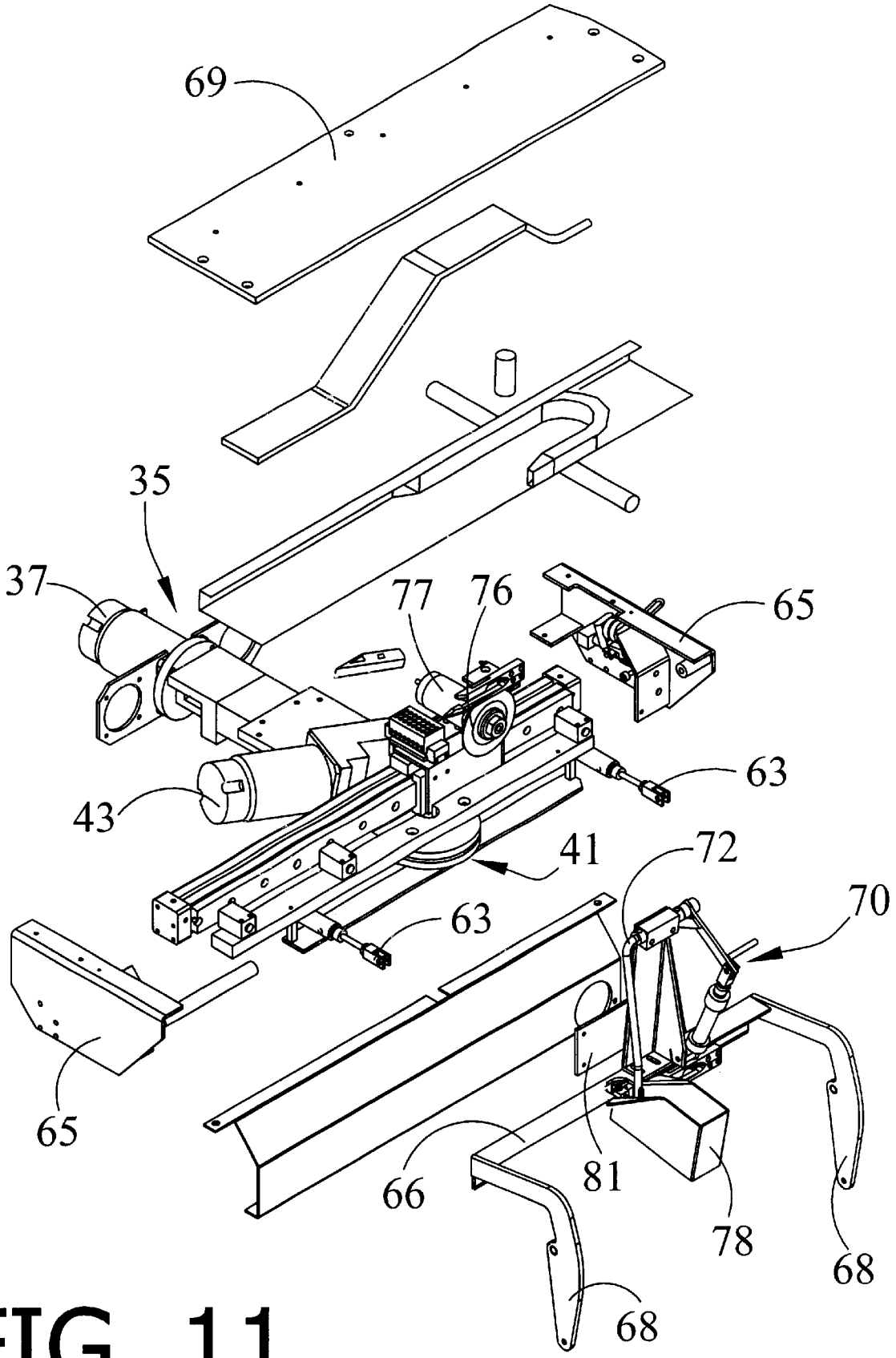
FIG. 11 is an exploded top perspective view of the shaping knife assembly of the present invention.
Figure 12:
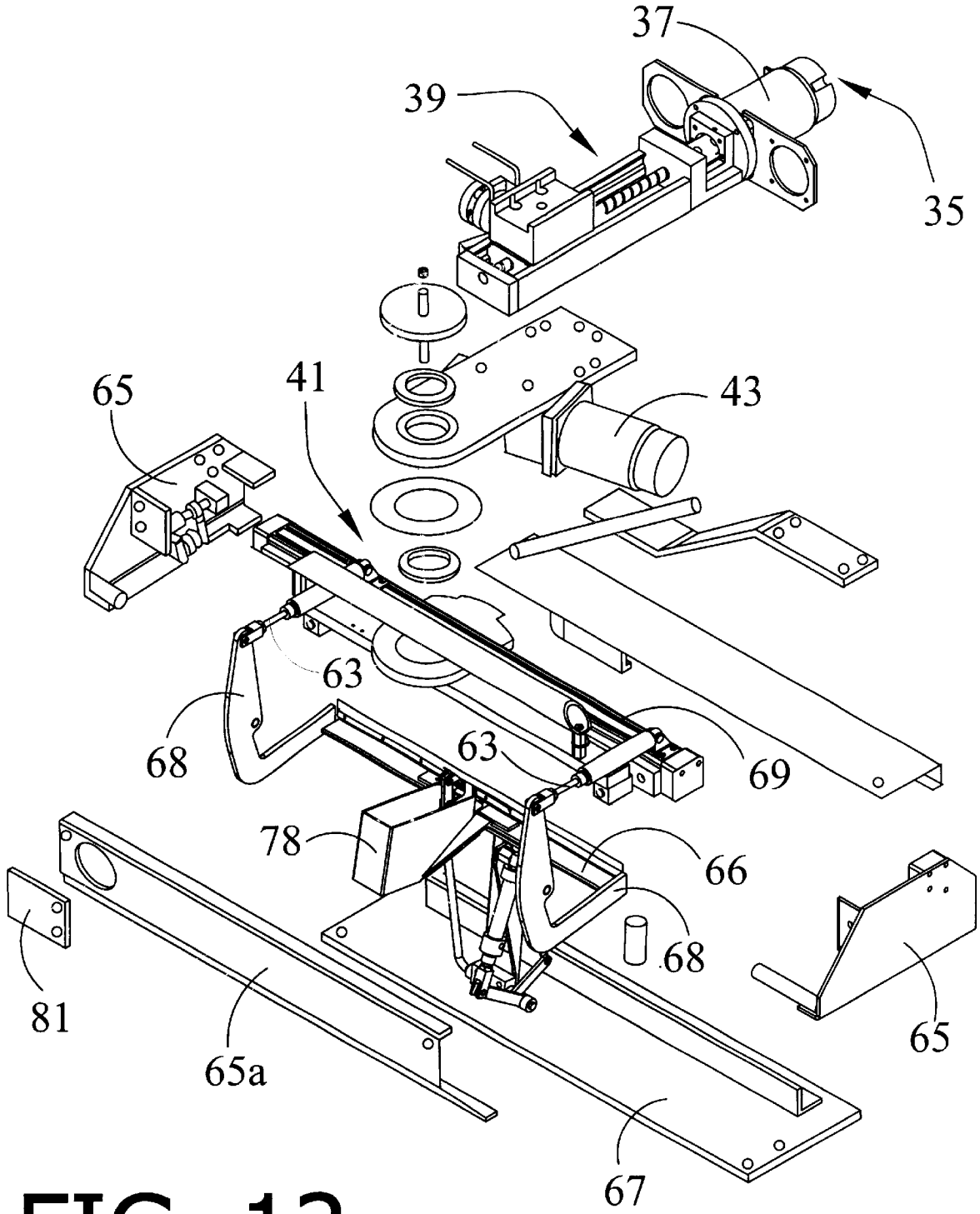
FIG. 12 is an exploded bottom perspective view of the shaping knife assembly of the present invention.

Looking at FIG. 10, a track 69 is mounted between the end plates 65, with the track 69 providing a means for laterally moving the first cutting member 76. A carriage member 71 is positioned on the track 69, and the first cutting member 76 is mounted to the carriage member 71. A track driving means (not illustrated), such as a hydraulic cylinder, worm gear, or similar driving mechanism known in the art, is surrounded by the track 69 and further is attached to the carriage member 71 to drive the carriage member 71 along the track 69. Therefore, the carriage member 71 will move along the track 69 while the first cutting member 76 is operating such that the first cutting member 76 will be able to trim the garment portion 18 as desired.

In operation, the clamping means 64 is pivoted between an open and shut position with respect to the clamping plate 67. In the open position, the clamping member 66 is positioned away from the clamping plate 67 such that the garment portion 18 may travel along the clamping plate 67. The garment portion 18 is carried via the first upper and lower folding belts 50*a*, 52*a*. Once the garment portion 18 is positioned as desired on the clamping plate 67, the clamping means 64 is pivoted to the shut position such that the clamping member 66 will engage the garment portion 18 to secure the garment portion 18 to the clamping plate 67. The first cutting member 76 is then driven along the track 69 such that the first cutting member 76 will engage and trim the garment portion 18.

The shaping knife assembly 32 additionally includes notching means 70 that is used to contact the garment portion 18 to provide a notch mark on the garment portion 18. The notching means 70 includes an arm member 72 pivotally attached to the clamping member 66, with a heated element 74 attached to the free end of the arm member 72. The heated element 74 is heated to an extent that contact by the heated element 74 to the garment portion 18 will cause a burn mark or notch to appear on the garment portion 18. As a result, after the first cutting member 76 has trimmed the desired shape in the garment portion 18, the arm member 72 is pivoted such that the heated element 74 of the notching means 70 is brought into contact with one edge of the garment portion 18, creating a burn mark or notch in the garment portion 18. The notch mark in the garment portion 18 serves as a visual guide for the person sewing the garment portion 18 onto the rest of the garment. The notching means 70 is protected by a heat shield 78 (see FIG. 9A) attached to the clamping means 64. The heat shield 78 helps to prevent the user from making undesired contact with the heated element 74. Moreover, a jet 80 (see FIG. 9C) may additionally be attached to the clamping means 64 to blow waste out of the way of the notching means 70 so that the heated element 74 does not come into contact with the waste material.

Looking at FIGS. 2, 4, 6, 13, and 14, the garment portion 18 next travels from the shaping knife assembly 32 to the width knife assembly 33 via the long upper and lower folding belts 50*a*, 52*a*. Since garment portions 18 are often wider than required for the garment, it is beneficial and often necessary to be able to reduce the width. Looking at FIGS. 13 and 14, the width knife assembly 33 includes a second cutting member 82 that is positioned proximate a support plate 88 and auxiliary plate 90. In the preferred embodiment, both the first cutting member 76 and the second cutting member 82 are razor disks, although many other cutting devices may be employed to achieve the desired cut (for example, scissors, a crush cut blade, and other embodiments of blades). The width knife assembly 33 further includes a series of positioning belts 86 and timing pulleys 87 that are connected to the second cutting member 82 to control when the second cutting member 82 engages the garment portion 18.

In operation, the garment portion 18 is directed from the shaping knife assembly 32 onto the support plate 88 via the long upper and lower folding belts 50*a*, 52*a*. The positioning belts 86 provide the required clamping action adjacent to the second cutting member 82 such that the garment portion 18 is pulled smoothly through the width knife assembly 33 and the second cutting member 82 (which is driven by a second motor 83) cuts the garment portion 18. The section of the garment portion 18 that is cut from the desired garment portion 18 is discharged through a cloth chute 99 (see FIG. 1), and the remaining garment portion 18 is sent to the garment receiving assembly 16.

Figure 13:
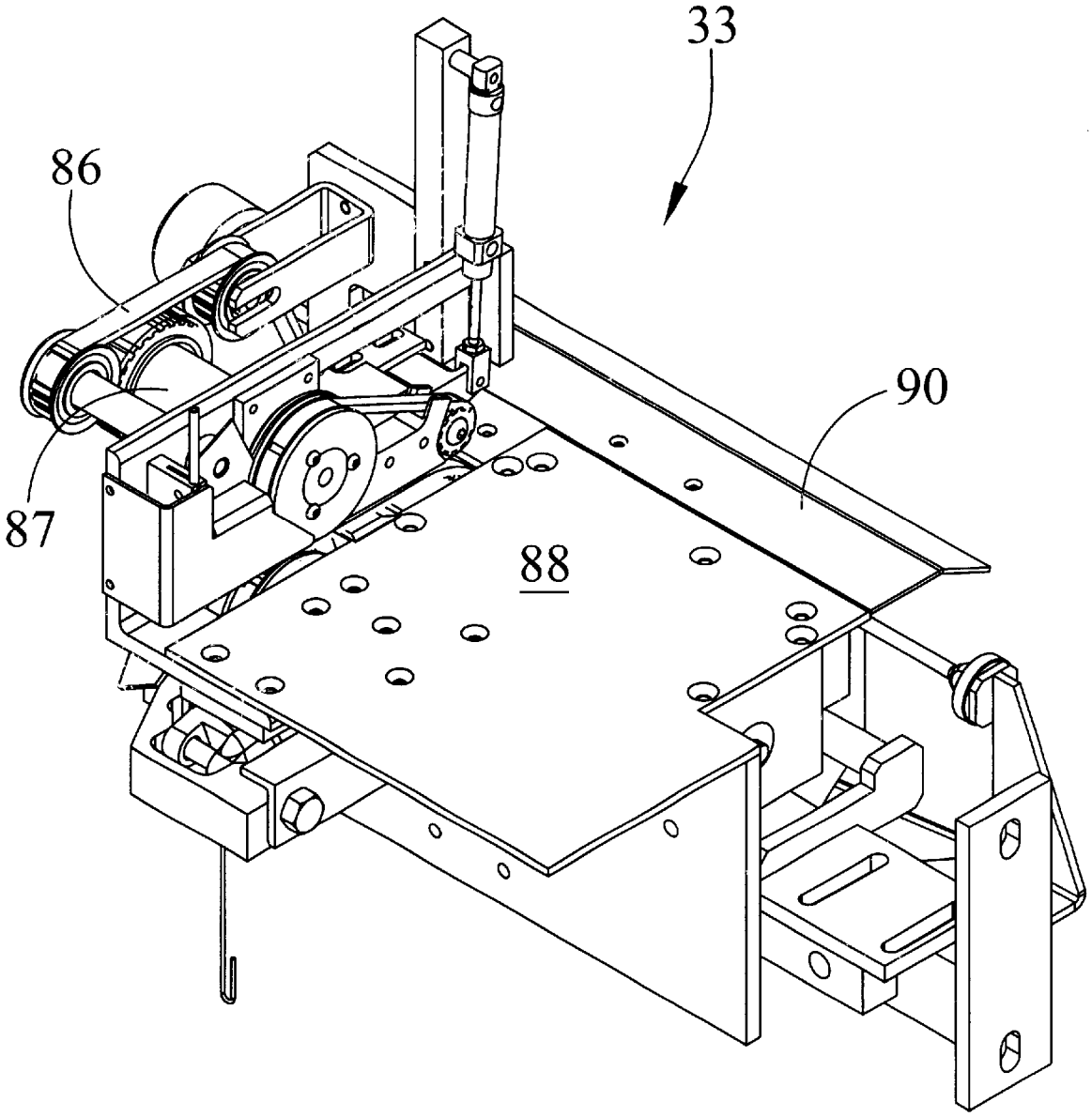
FIG. 13 is a top perspective view of the width knife assembly of the present invention.
Figure 14:
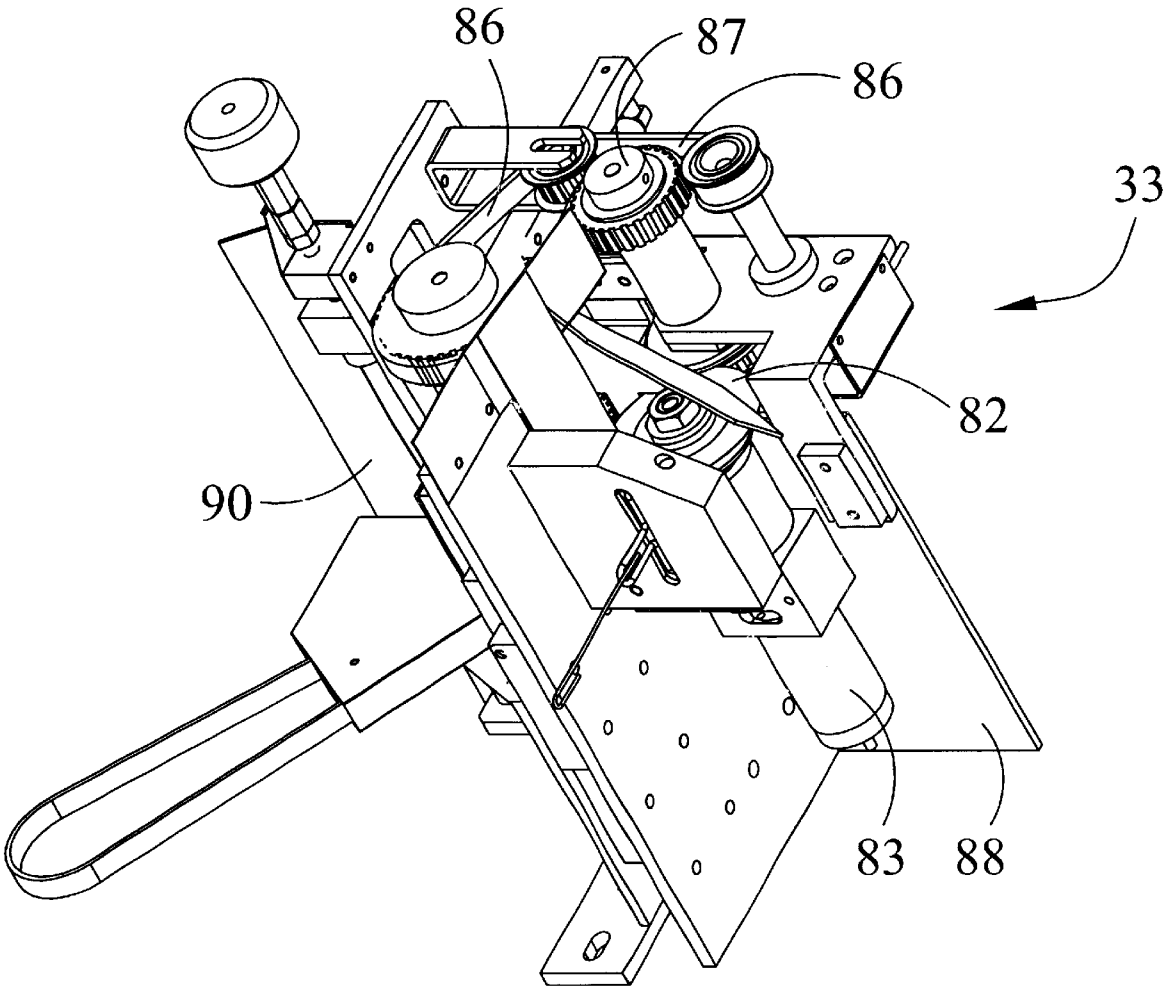
FIG. 14 is a bottom perspective view of the width knife assembly of the present invention as illustrated in FIG. 13.

To control the operation of the various elements of the garment portion cutting apparatus 14 described above, a control means 100 is additionally provided, as illustrated in FIG. 1. The control means 100 preferably comprises a central processing unit (not illustrated) having a touch-screen monitor 102 to allow easy interaction for the user to input the desired pattern for the garment portion 18 to be cut. The central processing unit of the control means 100 is programmed with a control algorithm that calculates the various times in which the garment portion 18 should be stopped for trimming to take place in the shaping knife assembly 32 and the width knife assembly 33. The control means 100 is used to control the precise stopping location of the garment portion 18, which is necessary to provide the proper shape for the garment portions 18 as required. The control means 100 also allows the burn mark to be placed in a precise location on the garment portion 18 for future clothes assemblers. Moreover, the control means 100 is also used to control the shaping knife assembly 32 and the width knife assembly 33 so that the first and second cutting members 76, 82 are positioned to provide the desired cut. Based on the precise stopping location of the garment portion 18 for the angle cut, the control algorithm further calculates edge position of the garment portion 18 and tracks this location in order to initiate the required clamping action of the positioning belts that pull the garment portion 18 smoothly through the width knife assembly 33 as the width cut is made, as illustrated in FIG. 13.

As stated above, the garment portion 18 is transported to the garment receiving assembly 16 (as illustrated in FIG. 1) after it is processed by the width knife assembly 33. The garment receiving assembly 16 serves to stack the trimmed garment portion 18 in a group with other previously trimmed garment portions 18. The garment portion 18 is ejected from the width knife assembly 33 on to a collector member 91, which can be a bar or series of fingers that are pivotally mounted proximate a receiving plate 92. Once the garment portion 18 is positioned on the collector member 91, the collector member 91 is rotated. The garment portion 18 is then pushed into engagement with a support member 94, which is resiliently attached to the receiving plate 92. As additional garment portions 18 are pushed into engagement with the support member 94, the support member 94 will also be pushed backward on the receiving plate 92. This will allow a stack of garment portions 18 to be arranged on the receiving plate 92.

An advantage to the invention described above is the efficiency in producing garment portions 18 for further garment production. The design described above can produce more garment portions 18 than other known devices or methods for producing garment portions 18. For example, the present invention can produce approximately 4330 garment portions in one eight-hour shift. Moreover, the present invention reduces the requirement for actual workers in that only one worker is required during operation to maintain consistent and steady operation of the invention.

It is to be understood that the form of the GARMENT PORTION PROCESSING ASSEMBLY described is a preferred embodiment thereof and that various changes and modifications may be made therein without departing from the spirit of the invention or scope as defined in the following claims.

What is claimed is:

1. A garment portion processing assembly for trimming a garment portion into a desired shape before attachment to a garment, the garment portion processing assembly comprising:

a stack queuing assembly for organizing a plurality of garment portions for iterative processing of garment portions;

a garment portion cutting apparatus positioned proximate said stack queuing assembly to receive the garment portion from said stack queuing assembly for trimming the garment portion, said garment portion cutting apparatus including a shaping knife assembly and a width knife assembly for trimming the garment portion; and a garment receiving assembly connected to said garment portion cutting apparatus, said garment portion cutting apparatus delivering the garment portion to said garment receiving assembly.

2. The garment portion processing assembly as described in claim 1 wherein said garment portion cutting apparatus further comprises:

a frame;

a folding assembly for collecting the garment portions from said stack queuing assembly and folding the garment portions;

wherein said shaping knife assembly is connected to said folding assembly to receive the folded garment portion and cut the garment portion according to the shape desired; and wherein said width knife assembly is connected to said shaping knife assembly to receive said folded and shaped garment portion and cut the garment portion according to the desired width.

3. The garment portion processing assembly as described in claim 2 wherein said folding assembly comprises:

a gripper member positioned above the garment portions on said stack queuing assembly;

means for elevating said gripper member, said elevating means being attached to said frame to vertically move said gripper member to collect and raise the garment portion from said stack queuing assembly; and a garment plate slidably mounted to said frame for reciprocal horizontal movement to engage one garment portion when the garment portion is raised by said gripper member.

4. The garment portion processing assembly as described in claim 3 wherein said folding assembly further comprises:

at least one upper folding belt rotatably mounted to said frame, said upper folding belt rotating at a first speed;

at least one lower folding belt rotatably mounted to said frame proximate said upper folding belt, said lower folding belt rotating at a second speed;

said upper folding belt and said lower folding belt positioned in close relation to said garment plate such that said garment plate slides between said upper folding belt and said lower folding belt;

wherein said upper folding belt rotates at said first speed and said lower folding belt rotates at said second speed such that when said garment plate slides between said upper folding belt and said lower folding belt, said upper folding belt and said lower folding belt engage the garment portion to center the garment portion on said garment plate such that the edges of the garment portion are aligned on said garment plate.

5. The garment portion processing assembly as described in claim 4 wherein said upper folding belt comprises three upper grooves and two upper ridges and said lower folding belt comprises two lower grooves and three lower ridges such that said two upper ridges are complimentary positioned with respect to said three lower grooves.

6. The garment portion assembly as described in claim 1 wherein said shaping knife assembly comprises:

a first cutting member attached to said frame;

lateral placing means for laterally positioning said first cutting member relative to said folding assembly, said lateral placing means attached to said frame;

driving means for laterally moving said first cutting member to contact the garment portion, said driving means connected to said lateral placing means; and swivel means for angularly positioning said first cutting member according to the desired shape to be cut, said swivel means connected to said lateral placing means.

7. The garment portion processing assembly as described in claim 6 wherein said shaping knife assembly further comprises clamping means for securing the garment portion to said frame at a selected position.

8. The garment portion processing assembly as described in claim 7 wherein said clamping means comprises:

a pair of arms pivotally connected to said frame;

a clamping member connected between said pair of arms;

a clamping plate attached to said frame;

wherein said pair of arms rotate between an open position wherein said clamping member is detached from said clamping plate and a closed position wherein said clamping member is juxtaposed to said clamping plate with the garment portion secured between said clamping plate and said clamping member.

9. The garment portion processing assembly as described in claim 6 wherein said lateral placing means comprises:

a worm screw assembly connected to said first cutting member; and a primary motor corrected to said worm screw assembly, wherein the operation of said worm screw assembly varies the lateral position of said first cutting member relative to said folding assembly.

10. The garment portion processing assembly as described in claim 6 wherein said driving means comprises:

a track; and a carriage member engaging said track, wherein said first cutting member is connected to said carriage member such that said carriage member longitudinally moves the first cutting member along said track to trim the garment portion.

11. The garment portion processing assembly as described in claim 1 wherein said shaping knife assembly further comprises notching means pivotally attached to said clamping means.

12. The garment portion processing assembly as described in claim 11 wherein said notching means comprises an arm member having a first and second end, said first end of said arm member pivotally connected to said clamping means, and a heated element attached to second end of said arm member such that said heated element will form a notch mark on the garment portion when said arm pivots toward the garment portion.

13. The garment portion processing assembly as described in claim 6 wherein said first cutting member comprises a razor disk.

14. The garment portion processing assembly as described in claim 1 wherein said width knife assembly comprises:

a second cutting member;

a secondary motor attached to said second cutting member to drive said second cutting member;

wherein said secondary cutting member is positioned to trim the width of the garment portion.

15. The garment portion processing assembly as described in claim 14 wherein the second cutting member comprises a razor disk.

16. The garment portion processing assembly as described in claim 2 further comprising control means connected to said garment portion cutting apparatus, said control means governing the operation of said folding assembly, said shaping knife assembly, and said width knife assembly.

17. A garment portion cutting apparatus for receiving a garment portion from a stack queuing assembly and preparing the garment portion to be sewn to a garment, said apparatus comprising:

a frame;

a folding assembly for collecting the garment portions from the stack queuing assembly and folding the garment portions;

a shaping knife assembly connected to said folding assembly, said shaping knife assembly receiving the folded garment portion and cutting the garment portion according to the shape desired; and a width knife assembly connected to said shaping knife assembly, said width knife assembly receiving said folded and shaped garment portion and cutting the garment portion according to the desired width.

18. The garment portion cutting apparatus as described in claim 17 wherein said folding assembly comprises:

a gripper member positioned above the garment portions on the stack queuing assembly;

elevating means attached to said frame, said gripper member being attached to said elevating means such that said elevating means vertically positions said gripper member to collect and raise the garment portion from the stack queuing assembly; and a garment plate slidably mounted to said frame for reciprocal horizontal movement to engage one garment portion when the garment portion is raised by said gripper member.

19. The garment portion cutting apparatus as described in claim 18 wherein said folding assembly further comprises:

at least one upper folding belt rotatably mounted to said frame, said upper folding belt rotating at a first speed;

at least one lower folding belt rotatably mounted to said frame proximate said upper folding belt, said lower folding belt rotating at a second speed;

said upper folding belt and said lower folding belt positioned in close relation to said garment plate such that said garment plate slides between said upper folding belt and said lower folding belt;

wherein said upper folding belt rotates at said first speed and said lower folding belt rotates at said second speed such that when said garment plate slides between said upper folding belt and said lower folding belt, said upper folding belt and said lower folding belt engage the garment portion to center the garment portion on said garment plate.

20. The garment portion cutting apparatus as described in claim 19 wherein said upper folding belt comprises three upper grooves and two upper ridges and said lower folding belt comprises two lower grooves and three lower ridges such that said two upper ridges are complimentary positioned with respect to said three lower grooves.

21. The garment portion cutting apparatus as described in claim 17 wherein said shaping knife assembly comprises:

a first cutting member attached to said frame;

lateral placing means for laterally positioning said first cutting member with respect to said folding assembly, said lateral placing means attached to said frame;

driving means for laterally moving said first cutting member to engage the garment portion, said driving means connected to said lateral placing means; and swivel means for angularly positioning said first cutting member, said swivel means connected to said lateral placing means.

22. The garment portion cutting apparatus as described in claim 21 wherein said shaping knife assembly further comprises clamping means for securing the garment portion to said frame at a selected position.

23. The garment portion cutting apparatus as described in claim 22 wherein said clamping means comprises:

a pair of arms pivotally connected to said frame;

a clamping member connected between said pair of arms;

a clamping plate attached to said frame;

wherein said pair of arms rotate between an open position wherein said clamping member is detached from said clamping plate and a closed position wherein said clamping member is juxtaposed to said clamping plate with the garment portion secured between said clamping plate and said clamping member.

24. The garment portion cutting apparatus as described in claim 21 wherein said lateral placing means comprises:

a worm screw assembly connected to said first cutting member; and a primary motor connected to said worm screw assembly, wherein the operation of said worm screw assembly varies the lateral position of said first cutting member relative to said folding assembly.

25. The garment portion cutting apparatus as described in claim 21 wherein said driving means comprises:

a track; and a carriage member engaging said track, wherein said first cutting member is connected to said carriage member such that said carriage member longitudinally moves the first cutting member along said track to trim the garment portion.

26. The garment portion cutting apparatus as described in claim 21 wherein said shaping knife assembly further comprises notching means pivotally attached to said clamping means.

27. The garment portion cutting apparatus as described in claim 26 wherein said notching means comprises an arm member having a first and second end, said first end of said arm member pivotally connected to said clamping means, and a heated element attached to second end of said arm member such that said heated element will form a notch mark on the garment portion when said arm pivots toward the garment portion.

28. The garment portion cutting apparatus as described in claim 27, wherein said notching means further comprises a heat shield connected to said clamping means, said heat shield substantially surrounding said heated element.

29. The garment portion cutting apparatus as described in claim 28, wherein said notching means further comprises an air jet attached to said clamping means, said air jet providing a stream of air toward the garment portion.

30. The garment portion cutting apparatus as described in claim 21 wherein said first cutting member comprises a razor disk.

31. The garment portion cutting apparatus as described in claim 21 wherein said width knife assembly comprises:

a second cutting member;

a secondary motor attached to said second cutting member to drive said second cutting member;

wherein said secondary cutting member is positioned to trim the width of the garment portion.

32. The garment portion cutting apparatus as described in claim 31 wherein the second cutting member comprises a razor disk.

33. The garment portion cutting apparatus as described in claim 17 further comprising control means to govern the operation of said folding assembly, said shaping knife assembly, and said width knife assembly.

* * * * *